US006902417B2

(12) United States Patent
Maegawa et al.

(10) Patent No.: US 6,902,417 B2
(45) Date of Patent: Jun. 7, 2005

(54) CONNECTOR AND A METHOD OF FORMING IT

(75) Inventors: Akihito Maegawa, Yokkaichi (JP); Shinji Ogawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/832,216

(22) Filed: Apr. 26, 2004

(65) Prior Publication Data

US 2004/0235328 A1 Nov. 25, 2004

(30) Foreign Application Priority Data

Apr. 25, 2003 (JP) ..... 2003-122274

(51) Int. Cl.[7] ..... H01R 13/64
(52) U.S. Cl. ..... 439/246; 439/247
(58) Field of Search ..... 439/246, 247, 439/248

(56) References Cited

U.S. PATENT DOCUMENTS 4,941,836 A * 7/1990 Bormuth ..... 439/247
4,966,557 A * 10/1990 Barkus et al. ..... 439/246
4,968,263 A * 11/1990 Silbernagel et al. ..... 439/246
5,971,774 A * 10/1999 Kuki et al. ..... 439/79
6,503,090 B2 * 1/2003 Onizuka ..... 439/75
6,514,090 B1 * 2/2003 Neal et al. ..... 439/75

FOREIGN PATENT DOCUMENTS

JP 2002-270420 9/2002

* cited by examiner

*Primary Examiner*—Ross Gushi
*Assistant Examiner*—Phuongchi Nguyen
(74) *Attorney, Agent, or Firm*—Gerald E. Hespos; Anthony J. Casella

(57) ABSTRACT

A connector (10) has a casing-side holding portion (11) that fits in an opening (H) in a casing (C), and device-side holding portions (12) for receiving connectors (KC) of a device (K) in the casing (C). Terminal holding portions (30) are fixed to branches (22) of busbars (20), and covers (40) are held onto the terminal holding portions (30). An outer covering element (60) has a coupled portion (61) and a separated portion (62). The coupled portion (61) is coupled to the covers (40) and includes the casing-side holding portion (11). The separated portion (62) is separated from the covers (40) and includes the device-side holding portions (12). Displacement permitting spaces (51) are defined between the branches (22) and the covers (40) to permit displacements of the branches (22).

10 Claims, 9 Drawing Sheets

CONNECTOR AND A METHOD OF FORMING IT

BACKGROUND OF THE INVENTION

1. Field of the Invention

The invention relates to a connector and to a method of forming it.

2. Description of the Related Art

Japanese Unexamined Patent Publication No. 2002-270420 relates to a connector including an assembly formed by molding an outer cover around a terminal. This connector has a connector portion located at one end of a coil device accommodated in a casing and connectable with a connector located outside the casing. This connector portion is comprised of a terminal connected with a coil and an outer covering molded around the coil and the terminal. A coil side of this coil device is held in a device in the casing, whereas a connector side is held while being fit in an opening made in the casing.

The coil side and the connector side are held onto different parts in the coil device. Thus, forces to deform the terminal and the outer cover act on the terminal and the outer covering element if there is a relative displacement between the two parts. The outer cover covers the terminal without clearance. Accordingly, there is a danger of cracking the outer cover if there is relative displacement between the terminal and the outer cover.

The invention was developed in view of the above problem and an object thereof is to take up a displacement without cracking an outer cover.

SUMMARY OF THE INVENTION

The invention relates to a connector having an outer covering element formed by molding. The connector also has a cover arranged around at least one terminal. The outer covering element comprises a coupled portion coupled to the cover and a separated portion separated from the cover. The coupled portion and the separated portion are separate from each other, and a displacement permitting area is defined between the terminal and the cover. The displacement permitting area permits the terminal to be displaced with respect to the cover if the coupled portion and the separated portion of the outer covering element are displaced from each other. Thus, the displacement can be taken up without causing a crack or the like in the outer covering element.

A terminal holding portion preferably is to be fixed to the terminal and the cover and can be held onto the terminal holding portion. The terminal holding portion can position the terminal and the cover in advance. Thus, the outer covering element can be formed easily by molding.

The outer covering element may be formed with a plurality of assemblies placed one substantially over another. Each assembly has a plurality of terminals arranged substantially side by side and held by the terminal holding portion. The cover then is held on the terminal holding portion. Each terminal holding portion is fixed to the terminals at at least two positions, and preferably at opposite sides of the corresponding cover. Each cover preferably has two divided pieces mountable on the terminals in directions intersecting the longitudinal direction of the terminals. Thus, the connector can have the terminals placed one over another at a plurality of stages.

Several terminals preferably are arranged substantially side by side, and each cover includes at least one partition for partitioning the terminals. The partition prevents the terminals from short-circuiting.

Each terminal may have a horizontally wide cross section, and a section of the terminal in the displacement permitting area may be bent along the vertical direction at an intermediate position so that dimensions of the section along horizontal and vertical directions are substantially equal. Thus, the sections of the terminals in the displacement permitting areas can be displaced along horizontal and vertical directions substantially with the same ease, and the displacement can be taken up satisfactorily.

A section of each terminal in the displacement permitting area may be narrower and dimensions of the narrow section along horizontal and vertical directions may be substantially equal. Thus, the sections of the terminals in the displacement permitting areas can be displaced along horizontal and vertical directions substantially with the same ease, and the displacement can be taken up satisfactorily.

The number of terminals arranged along horizontal direction and the number of the terminals arranged along vertical direction preferably are same. Thus, the displacement can be taken up more satisfactorily.

The invention also relates to a method of forming a connector. The method comprises forming an outer covering element of the connector by molding with a cover at least partly arranged around at least one terminal. The outer covering element is formed to have a coupled portion coupled to the cover and a separated portion separated from the cover, the coupled portion and separated portion are separate from each other, and a displacement permitting area is defined between the terminal and the cover for permitting a displacement of the terminal.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to the invention is identified by the numeral 10 in FIGS. 1 to 5. The connector 10 is mounted at an opening H of a casing C and connects to a device K that is mounted to an inner surface of the casing C by bolts B. The casing C may be part of an automatic transmission to be mounted in an automotive vehicle. In the following description, reference is made to all the figures except FIG. 1 concerning vertical and transverse directions unless particularly specified.

Figure 1:
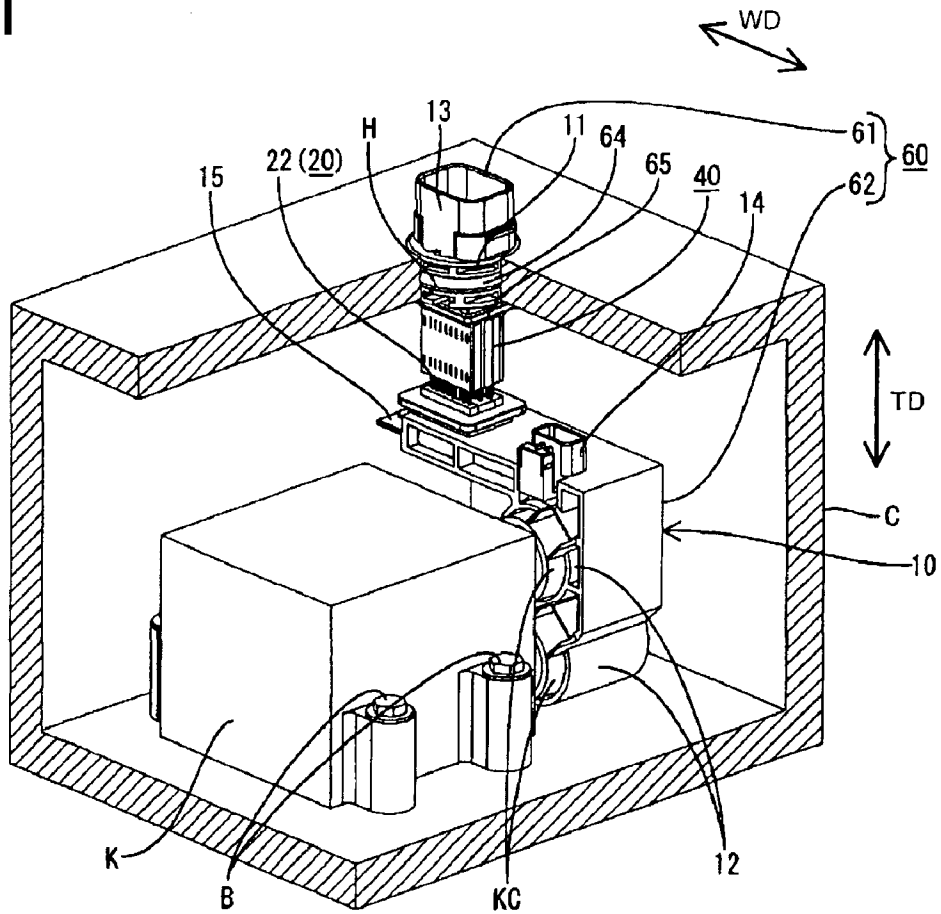
FIG. 1 is a perspective view showing a mounted state of a connector according to a first embodiment of the invention.

The connector 10 has a bent shape, as shown in FIG. 1, and has a casing-side holding portion 11 at one end and two device side holding portions 12 at the opposite end. The casing-side holding portion 11 is fit into the opening H and held on the casing C. The device-side holding portions 12 are held on the device K in the casing C by being connected with device connectors KC. The casing-side holding portion 11 has an external connecting portion 13 that projects out from the casing C for connection with an external power-supply connector (not shown). Device connecting portions 14, 15 are provided between the holding portions 11, 12 of the connector 10 and are connectable with other devices (not shown) disposed in or on the casing C.

The connector 10 is comprised of busbars 20, terminal holding portions 30 formed around the busbars 20 by primary molding, covers 40 held on the terminal holding portions 30, and an outer covering element 60 formed around the terminal holding portions 30 and the covers 40 by secondary molding. Several busbars 20 are arranged substantially side by side and are held together by one of the terminal holding portions 30, and three stages of the terminal holding portions 30 are fixed by the outer covering element 60 to form the connector 10. The number of the busbars 20 used differs from stage to stage. In the example shown in FIGS. 2 to 4, three, two and four busbars are used at the upper, middle and lower stages, respectively.

Figure 2:
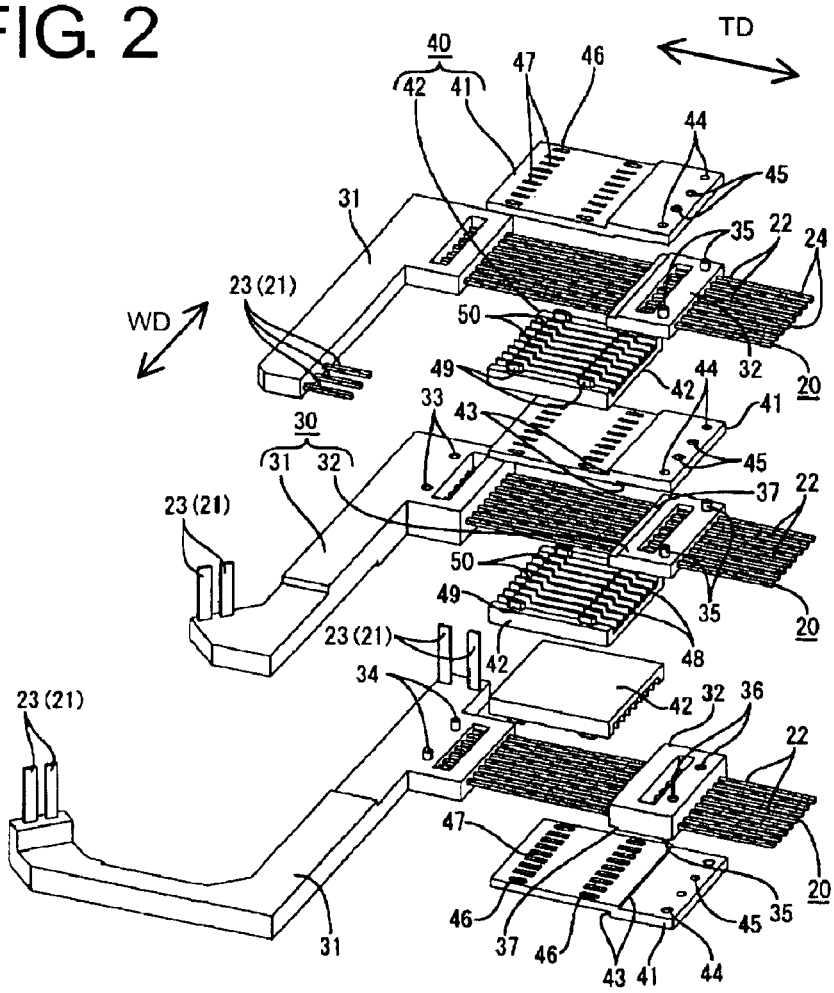
FIG. 2 is a perspective view showing a state before covers are mounted on groups of busbars held by the terminal holding portions.

As shown in FIG. 2, each busbar 20 is formed into a specified shape by bending, folding and/or embossing a cut or stamped-out conductive metallic plate and is comprised of a base 21 and branches 22 that branch off from the base 21. The base 21 is arranged at the device-side holding portion 12 or the device connecting portion 14, 15, and the branches 22 are arranged at the external connecting portion 13. The base 21 extends in a widthwise direction WD and is covered substantially entirely by the terminal holding portion 30. However, a device contact 23 is formed at an end of the base 21 opposite from the branches 22 and projects from the terminal holding portion 30. The device contact 23 is electrically connectable with a terminal of the corresponding device K. More specifically, the bases 21 at the upper stage in the shown example project forward from their positions coupled to the branches 22. The device contacts 23 then project laterally to right and into the device connecting portion 14 shown at the front side in FIG. 4. The bases 21 at the middle stage extend forward from their positions coupled to the branches 22 and then are bent laterally to left. The device contacts 23 then project up and into the right device-side holding portion 12 shown in FIG. 4. Two bases 21 at the lower stage extend toward the back side and the device contacts 23 project up and into the device connecting portion 15 shown at the back side in FIG. 4. The other two bases 21 at the lower stage extend forward and are then bent laterally to the left and the device contacts 23 project up and into the left device-side holding portion 12 shown in FIG. 4.

The branches 22 extend substantially straight along the transverse direction TD and substantially normal to widthwise direction WD. The branches 22 are fixed by the terminal holding portion 30 at two positions, namely at the left end, which is coupled to the respective base 21, and at an intermediate position. Right ends of the branches 22 define external contacts 24 that are electrically connectable with terminals of corresponding power-supply connectors. The number of the branches 22 at each stage is set e.g. at eight (a total of twenty four branches). Two or three branches 22 are coupled to each of the three bases 21 at the upper stage; four branches 22 are coupled to each of the two bases 21 at the middle stage; and two branches 21 are coupled to each of the four bases 21 at the lower stage. Each branch 22 has width that is larger than its thickness, and hence each branch 22 has a wide cross section (see FIG. 5). The shapes of the bases 21 differ depending on the busbars 20. However, all of the branches 22 have substantially identically shapes.

As shown in FIG. 2, each terminal holding portion 30 includes first and second holding portions 31 and 32. Each first holding portion 31 is fixed to substantially the entire areas of the bases 21 of the busbars 20 and to the left ends of the branches 22. Each second holding portion 32 is fixed at the intermediate positions of the branches 22. Thus, each terminal holding portion 30 is divided into two parts fixed to the branches 22 at substantially opposite sides of the cover 40. In this way, the respective branches 22, including the external contacts 24, are held substantially parallel and at substantially even intervals. The first holding portions 31 are shaped in conformity with the bases 21 of the busbars 20 at each stage and have different shapes depending on the stage. A pair of positioning recesses 33 are formed in each of the upper and lower surfaces of the first holding portion 31 at the middle stage, whereas a pair of positioning projections 34 are on the upper surface of the first holding portion 31 at the lower stage and the lower surface of the first holding portion 31 at the upper stage. The positioning recesses in the lower surface of the first holding portion 31 at the middle stage and the positioning projections of the first holding portion 31 at the upper stage are not shown.

Each second holding portion 32 has engaging projections 35 to hold the cover 40 in its mounted state and positioning recesses 36 and/or positioning projections (not shown) for positioning the second holding portion 32 or the cover 40 at the other stage. More specifically, two engaging projections 35 are provided on the upper surface of the second holding portion 32 at the upper stage and are engageable with engaging holes 44 of a first covering member 41 at the upper stage. Two positioning projections (not shown) are provided on the lower surface of the second holding portion 32 at the upper stage and are engageable with positioning holes 45 in a first covering member 41 at the middle stage. Two engaging projections 35 are provided on the upper surface of the second holding portion 32 at the middle stage and are engageable with engaging holes 44 of the first covering member 41 at the middle stage. Two positioning projections (not shown) are provided on the lower surface of the second holding portion 32 at the middle stage and are engageable with positioning recesses 36 in the upper surface of the second holding portion 32 at the lower stage. Two positioning recesses 36 are formed in the upper surface of the second holding portion 32 at the lower stage, whereas two engaging projections 35 are on the lower surface of the second holding portion 32 at the lower stage for engagement with engaging holes 44 in a first covering member 41 at the lower stage. The second holding portions 32 at the upper and middle stages are thinner than the second covering members 42 of the corresponding covers 40, and the second holding portion 32 at the lower stage is thicker than the second covering member 42 of the corresponding cover 40. Accordingly, when the assemblies of the busbars 20, the terminal holding portions 30 and the covers 40 are placed one over another, the second covering member 42 at the upper stage contacts a step 43 of the first covering member 41 at the middle stage and the second covering member 42 at the middle stage contacts the left end surface of the second holding portion 32 at the lower stage to position the respective stages (see FIG. 3). Further, steps 37 are formed in the upper surfaces of the second holding portions 32 at the upper and middle stages and in the lower surface of the second holding portion 32 at the lower stage.

As shown in FIG. 2, each cover 40 is divided into two parts to hold the busbars 20 from above and below, i.e. in directions substantially normal to the extension of the branches 22. Specifically, each cover 40 is comprised of the first covering member 41 detachably mountable on the second holding portion 32 of the corresponding terminal holding portion 30 and the second covering member 42 detachably mountable on the first covering member 41. Both upper and lower surfaces of the first covering member 41 are formed with the steps 43 that conform to and engage with the steps 37 of the corresponding second covering member 42 at the other stage and the corresponding second holding portion 32. Two of the engaging holes 44 and two of the positioning holes 45 are formed the first covering member 41 at the right side of the steps 43. A plurality of temporary holding holes 46 and a plurality of insertion grooves 47 are formed substantially in alignment.

The second covering member 42 has a comb-shaped cross section and includes partitions 48 arranged along the widthwise direction WD for partitioning the branches 22. Two transversely spaced temporary holding projections 49 are formed on an outer wall at each of the opposite lateral ends of the second covering member 42 and are engageable with the corresponding temporary holding holes 46 to temporarily hold the two covering members 41, 42 together. The temporary holding projections 49 are slightly larger than the temporary holding holes 46 and hence are squeezed and compressed slightly when pressed into the temporary holding holes 46. Two inserting pieces 50 are formed on the upper surface of each partition 48 at substantially the same positions as the temporary holding projections 49 with respect to the transverse direction TD and are insertable into the corresponding insertion grooves 47. The covers 40 at the three stages are substantially identical. The covers 40 at the upper and middle stages are used with the first covering members 41 located above, whereas the cover 40 at the lower stage is used with the first covering member 41 located above. The second covering member 42 is substantially transversely symmetrical and can be mounted easily without specifying an orientation with respect to the transverse direction TD.

Figure 3:
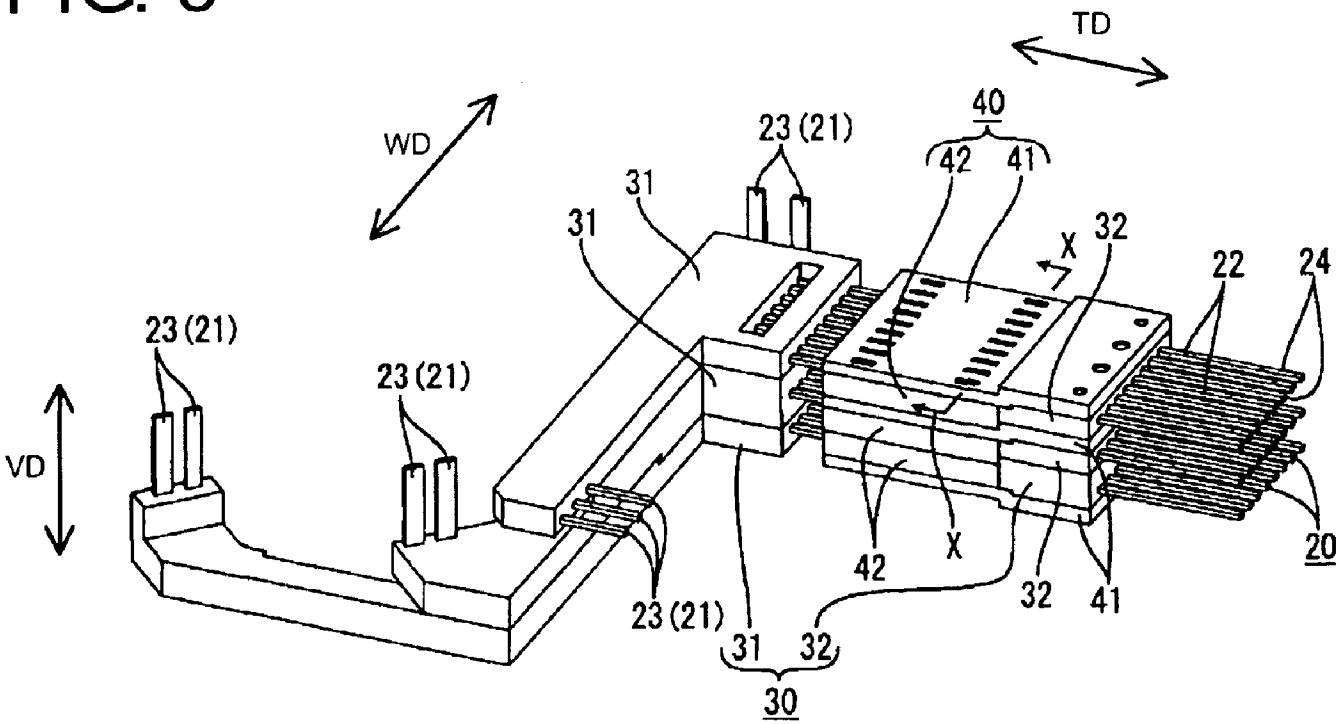
FIG. 3 is a perspective view showing the respective groups of busbars having the covers mounted thereon and placed one over another.
Figure 5:
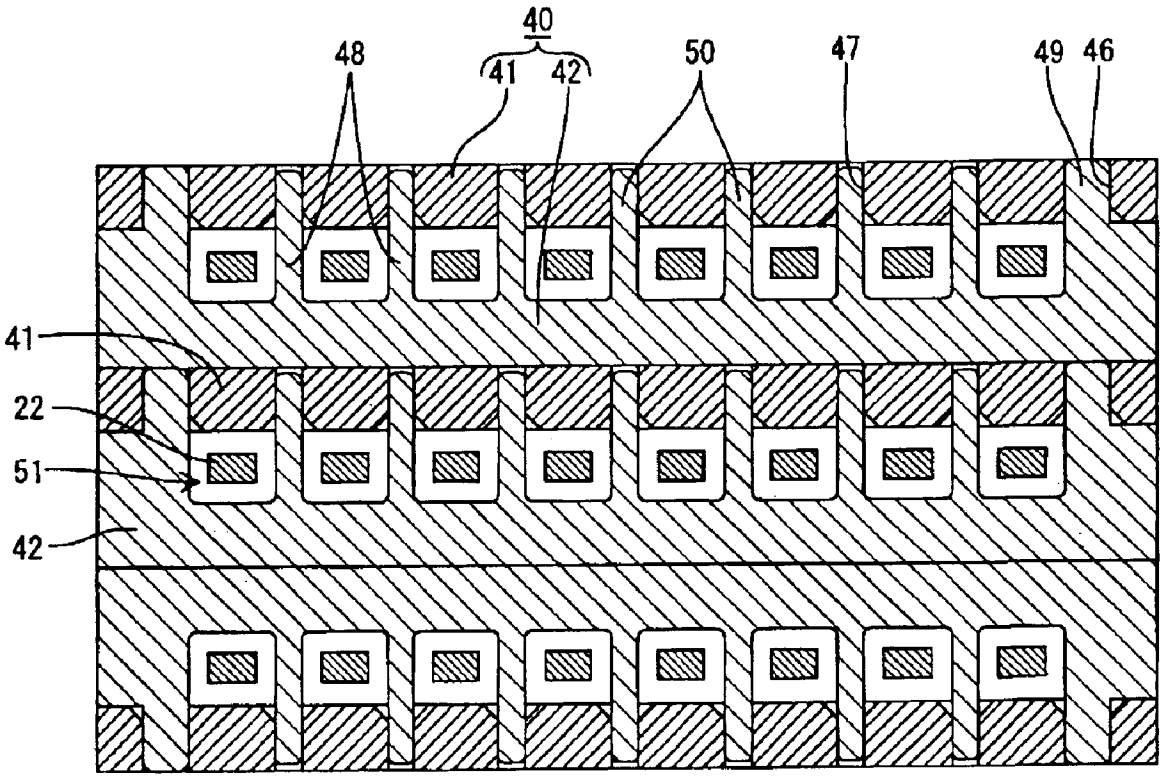
FIG. 5 is a section along 5—5 of FIG. 3.

The two covering members 41, 42 are assembled together and mounted partly onto the second holding portions 32 so that the covers 40 are spaced apart from the right ends of the first holding portions 31 by a specified distance, as shown in FIG. 3, and so that displacement permitting spaces 51 are defined between the covers 40 and the respective branches 22, as shown in FIG. 5. The displacement permitting spaces 51 permit relative displacements of the branches 22 with respect to the covers 40. More specifically, the first and second covering members 41, 42 of the covers 40 are spaced apart from the branches 22 by the displacement permitting spaces 51, and the respective branches 22 and the covers 40 are held so as not to contact each other. Accordingly, sections of the branches 22 between the first and second holding portions 31, 32 of the terminal holding portions 30 are displaceable within the displacement permitting spaces 51 with respect to the cover 40 substantially along a direction of a plane normal to the longitudinal direction thereof. In this way, relative displacements between a side of the first holding portions 31 (a side of a separated portion 62) and a side of the second holding portions 32 (a side of a coupled portion 61) may be at least partly taken up by deformations of the branches 22 in the displacement permitting spaces 51.

Figure 4:
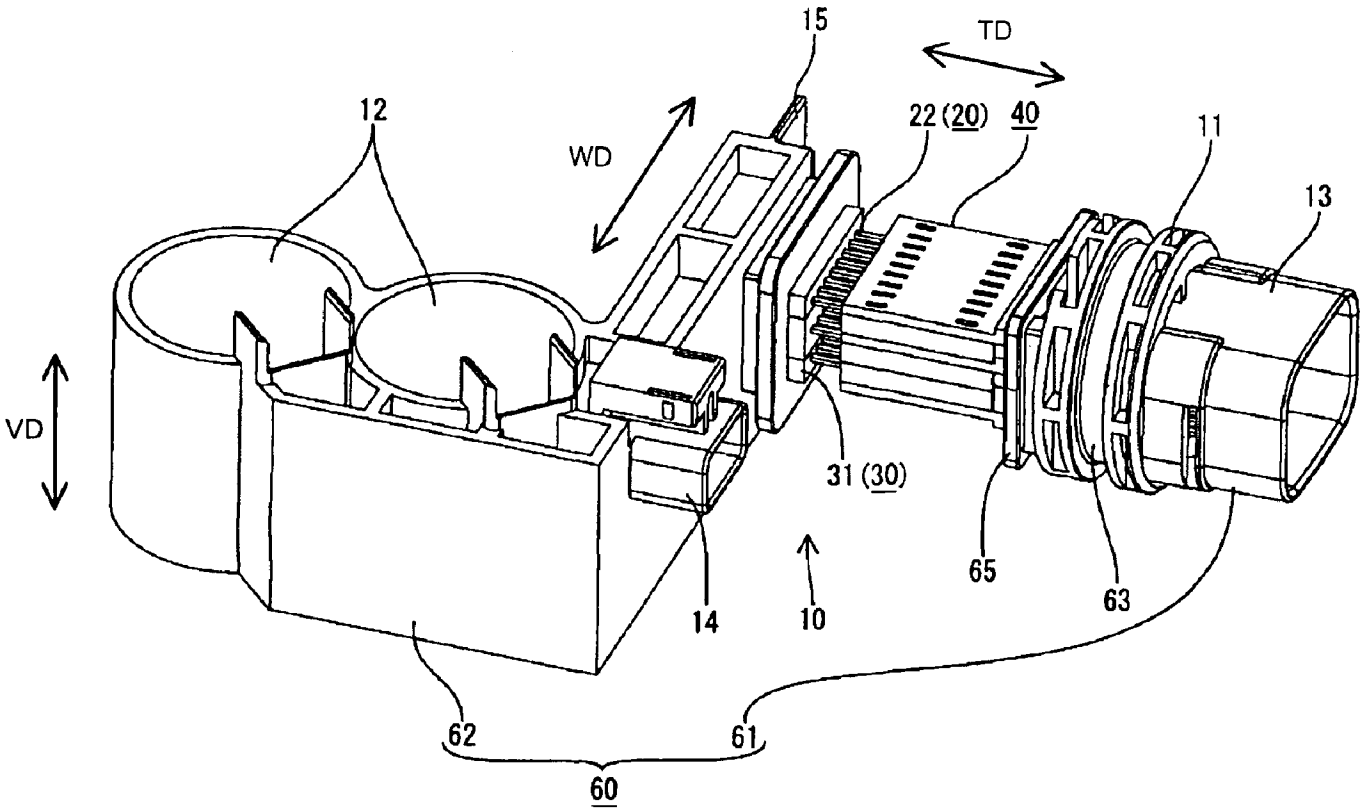
FIG. 4 is a perspective view showing a state where an outer covering element is formed by molding.

The outer covering element 60 is comprised of the coupled portion 61 and the separated portion 62. The coupled portion 61 includes the casing-side holding portion 11 and is coupled to the covers 40. The separated portion 62 includes the device-side holding portion 12 and the device connecting portions 14, 15 and is separated from the covers 40. Additionally the two portions 61, 62 are separate from each other. The coupled portion 61 covers the right ends of the covers 40 and the second holding portions 32 of the terminal holding portions 30, as shown in FIG. 4 and is provided with the substantially cylindrical casing-side holding portion 11. A seal-ring mounting groove 63 is formed in the outer circumferential surface of the casing-side holding portion 11 and receives a seal ring 64 that closely contacts the inner peripheral surface of the opening H to seal the opening H. A substantially rectangular flange 65 bulges out at the left side of the casing-side holding portion 11. The flange 65 contacts the inner surface of the casing C when the connector 10 is mounted into the casing C, thereby positioning the connector 10 (see FIG. 1). A rectangular tubular external connecting portion 13 is formed a the right side of the casing-side holding portion 11, and the external contact portions 24 of the respective branches 22 project inside the external connecting portion 13.

The separated portion 62 of the outer covering element 60 covers the first holding portions 31 of the terminal holding portions 30, excluding the right ends thereof. Two device-side holding portions 12 are arranged substantially side by side at a part of the separated portion 62 that projects to left. The device-side holding portions 12 are vertically hollow cylinders that extend substantially normal to the transverse direction TD and normal to the widthwise direction WD. Two device contact portions 23 of the busbars 20 are arranged in each device-side holding portion 12. The device connecting portion 14 is a substantially rectangular tube having an open right end at the front side of a right end portion of the separated portion 62 in FIG. 4. Three device contact portions 23 project in the device connecting portion 14. The device connecting portion 15 is at the back end of the separated portion 62 in FIG. 4, and two device contact portions 23 are exposed at the opposite sides of the device connecting portion 15.

Groups of busbars 20 of the respective stages are set in a mold for primary molding, and a molten resin is filled in the mold. The mold is opened after the resin is solidified to obtain primary products in each of which the terminal holding portions 30 fix the group of the busbars 20.

The covers 40 then are mounted on the respective primary products, as shown in FIG. 2. More particularly, the first and second covering members 41 and 42 are mounted onto the primary products at the upper and middle stages from above and below, respectively, and along the vertical direction VD. Similarly, the first and second covering members 41, 42 are mounted onto the primary product at the lower stage from below and above, respectively, and along the vertical direction VD. The steps 43 of the first covering members 41 engage the stepped recesses 37, and the engaging projections 35 fit into the engaging holes 44. Additionally, the covers 40 are positioned with respect to the second holding portions 32 of the corresponding terminal holding portions 30 and the temporary holding projections 49 are pressed and squeezed slightly into the temporary holding holes 46. Furthermore, the inserting pieces 50 are inserted into the corresponding insertion grooves 47. As a result, the covering members 41, 42 are assembled together temporarily. In this state, the displacement permitting spaces 51 are defined around the branches 22 and the branches do not contact the covers 40.

The primary products having the covers 40 mounted thereon then are assembled one over another. More particularly, the primary product of the middle stage is placed on the primary product of the lower stage as shown in FIG. 3. In this process, the positioning projections 34 fit into the unillustrated positioning recesses at the side of the first holding portions 31, the unillustrated positioning projections fit into the positioning recesses 36 at the side of the second holding portions 32, and the right end surface of the second covering member 42 of the middle stage contacts the left end surface of the second holding portion 32 of the lower stage to position these two primary products with respect to each other. Similarly, the primary product of the upper stage is placed on the primary product of the middle stage. In this process, the unillustrated positioning projections fit into the positioning recesses 33 at the side of the first holding portions 31, the unillustrated positioning projections fit into the positioning holes 45 at the side of the second holding portions 32, and the right end surface of the second covering member 42 of the upper stage contacts the stepped portion 43 of the first covering member 41 of the middle stage to position these two primary products with respect to each other. Of course, the above-described assembling procedure can be changed.

The primary products assembled as described above are set in a mold for secondary molding, and a molten resin is filled into the mold. The mold is opened after the resin is solidified to obtain a secondary product with the outer covering element 60 as shown in FIG. 4. The seal ring 64 then is mounted into the seal-ring mounting groove 63 and a sealant is fit into the external connecting portion 13 to complete the assembling of the connector 10.

The connector 10 then is mounted in the casing C and onto the device K. Specifically, the connector 10 is arranged in the casing C and the two device connectors KC of the device K are fit in the two device-side holding portions 12 to hold the connector 10 on the device K. The external connecting portion 13 of the connector 10 is introduced through the opening H of the casing C to be exposed to the outside, and the casing-side holding portion 11 is fit into the opening H until the flange 65 contacts the inner surface of the casing C to hold the connector 10 on the casing C. At this time, the seal ring 64 closely contacts the inner peripheral surface of the opening H to provide sealing between the casing-side holding portion 11 and the opening H. It should be noted that the device connectors KC may be fit after the external connecting portion 13 is fitted into the opening H.

As shown in FIG. 1, the device K is fixed to the casing C by the bolts B. At this time, the device K may be mounted at a position displaced from a proper position with respect to the casing C. If this happens, the device connectors KC also are displaced and the device-side holding portions 12 are displaced relative to the casing-side holding portion 11 of the connector 10. However, even in such a case, the separated portion 62 (including the device-side holding portions 12) and the coupled portion 61 (including the casing-side holding portion 11) are separated from each other, and the respective branches 22 of the busbars 20 are deformed in directions at an angle to their longitudinal directions. However, the deformed branches 22 escape into the displacement permitting spaces 51. Therefore, the displacement can be taken up without causing a crack in the outer covering element 60 or the like.

As described above, the coupled portion 61 and the separated portion 62 are formed separately. The coupled portion 61 is coupled to the covers 40, but the separated portion 62 is separated from the covers 40. Additionally the displacement permitting spaces 51 are between the branches 22 and the covers 40 for permitting displacement of the branches 22. Thus, even if the coupled portion 61 and the separated portion 62 are displaced from each other, the branches 22 can deform in the displacement permitting spaces 51 to accommodate the relative displacement without causing crack in the outer covering element 60 or the like.

The terminal holding portions 30 are fixed to the branches 22 and the covers 40 are held onto the terminal holding portions 30. The branches 22 and the covers 40 can be positioned in advance by the terminal holding portions 30 to facilitate the operation of molding the outer covering element 60. Furthermore, the respective branches 22 are partitioned by the partitioning portions 48 of the covers 40. Thus, the branches 22 can not short-circuit.

Figure 6:
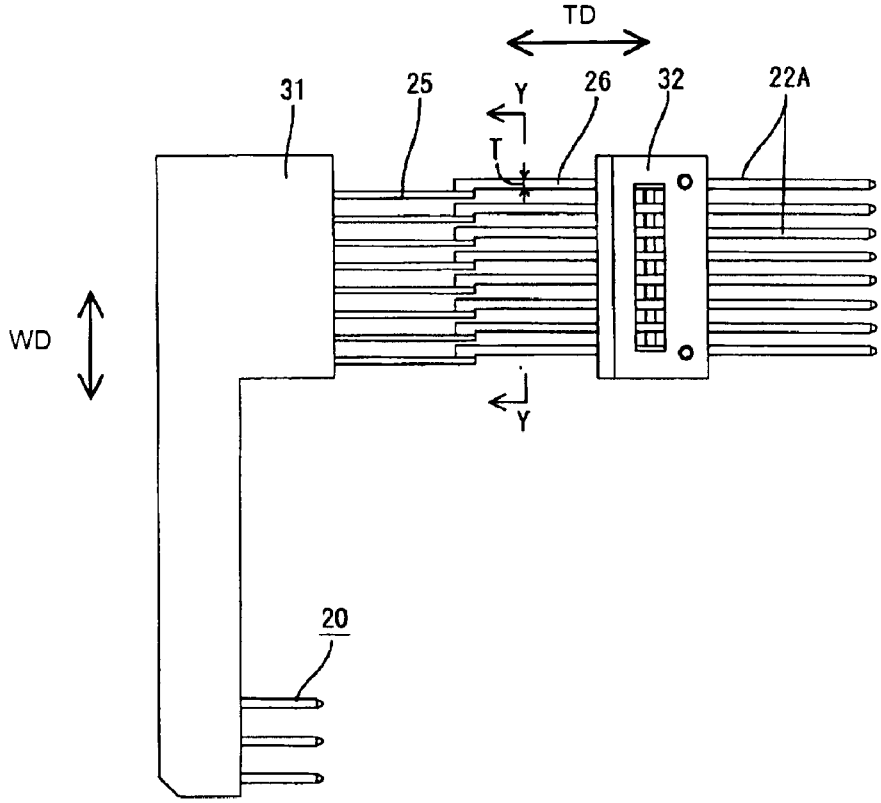
FIG. 6 is a plan view showing groups of busbars held by terminal holding portions according to a second embodiment of the invention.
Figure 7:
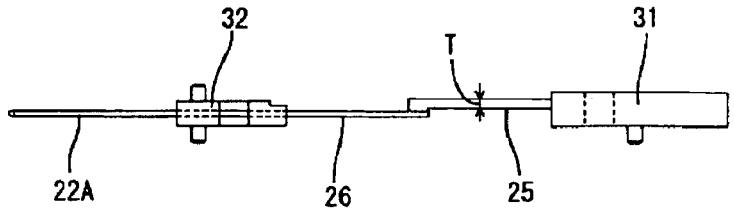
FIG. 7 is a right side view of FIG. 6.
Figure 8:
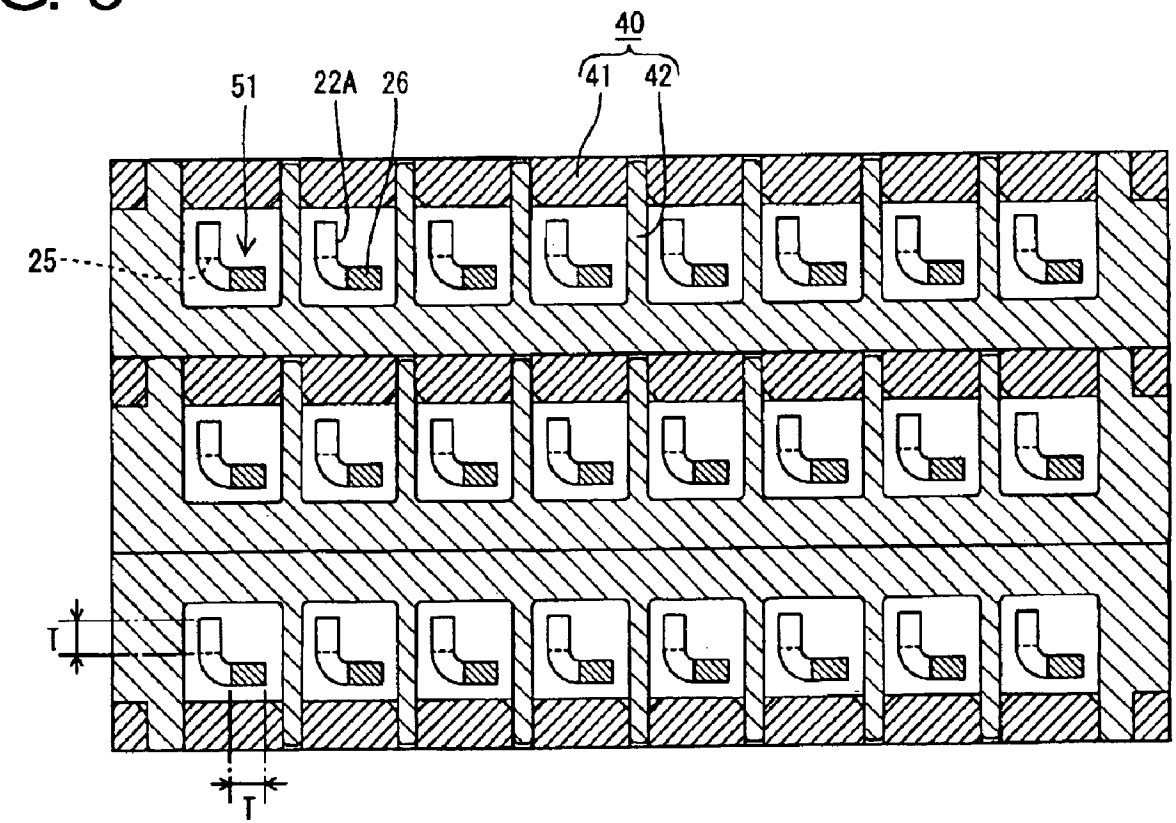
FIG. 8 is a section along 8—8 of FIG. 6 showing the groups of busbars having covers mounted thereon are placed one over another.

A second embodiment of the invention is described with reference to FIGS. 6 to 8. In the second embodiment, the shapes of the busbars 20 are changed. No repetitive description is given for elements of the second embodiment that are the same as the first embodiment. Rather, those similar elements merely are identified by the same reference numeral As shown in FIGS. 6 and 7, sections of branches 22A of the busbars 20 to be surrounded by the covers 40 in the displacement permitting spaces 51, are stepped at their intermediate positions. Specifically, each branch 22A is formed by cutting or stamping a base material to have a substantially cranked shape with two portions 25, 26 that extend in the transverse direction TD of FIGS. 6 and 7. However, the two portions 25, 26 of each branch 22A are displaced in the widthwise direction WD, which is substantially normal to the transverse direction TD. One displaced portion 25 then is bent substantially at a right angle to the other displaced portion 26 at their coupled position. Accordingly, the portion 25 of each branch 22A held by the first holding portion 31 has a vertically long cross section, whereas the portion 26 held by the second holding portion 32 has a horizontally wide cross section, and the larger sides of the cross sections of these two portions 25, 26 substantially equal a dimension T, as shown in FIG. 8.

The shapes of the covers 40 are changed from the first embodiment to ensure the displacement permitting spaces 51 between the covers 40 and the branches 22.

In the above construction, the branches 22A are displaced in the displacement permitting spaces 51 if the coupled portion 61 and the separated portion 62 of the outer covering element 60 are displaced from each other. Specifically, if a displacement occurs along the vertical direction in FIG. 8, the horizontally long sections 26 of the branches 22A are displaced in the displacement permitting spaces 51. If a displacement occurs along the horizontal direction in FIG. 8, the vertically long sections 25 of the branched portions 22A are displaced in the displacement permitting spaces 51. The branches 22A of the second embodiment are displaced along vertical and horizontal directions in the displacement permitting spaces 51 with substantially the same ease. Thus, the displacement can be taken up more satisfactorily.

A third embodiment of the invention is described with reference to FIGS. 9 and 10. In the third embodiment, the numbers of branches 22B at the respective stages are changed and the number of primary products to be placed one over another is changed after the shapes of the busbars 20 are changed. No repetitive description is given for elements of the third embodiment that are the same as the first embodiment. Rather, those similar elements merely are identified by the same reference numerals.

Figure 9:
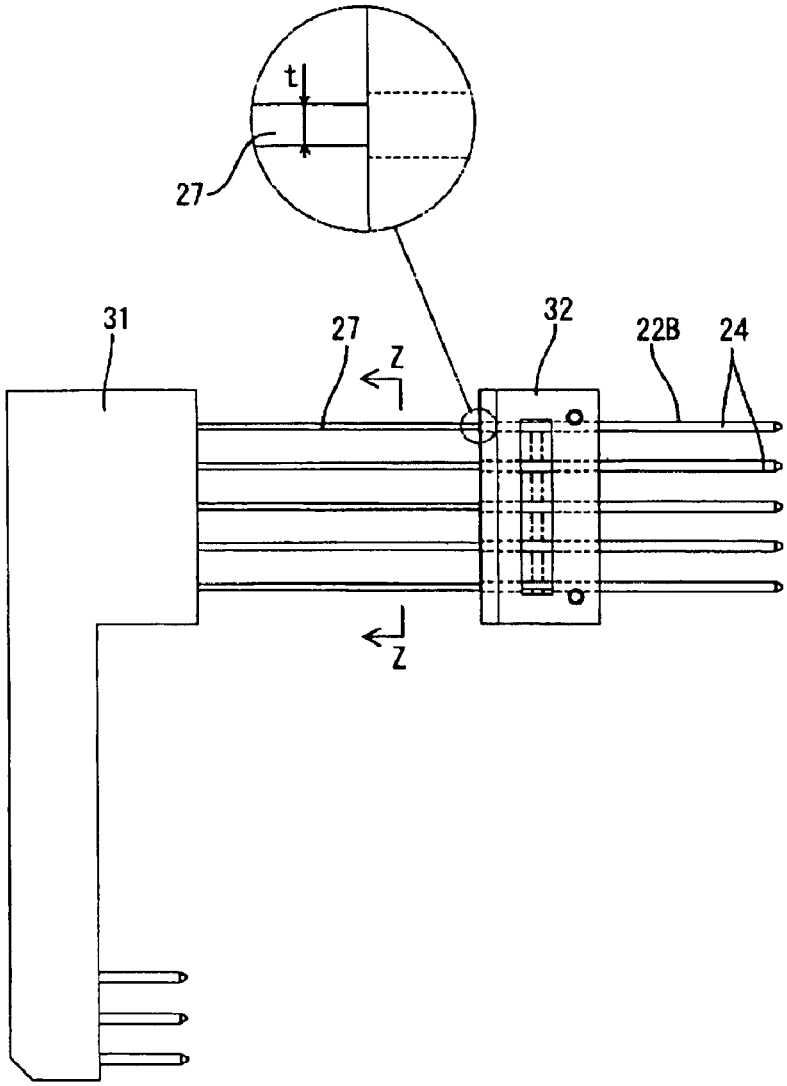
FIG. 9 is a plan view showing groups of busbars held by terminal holding portions according to a third embodiment of the invention.
Figure 10:
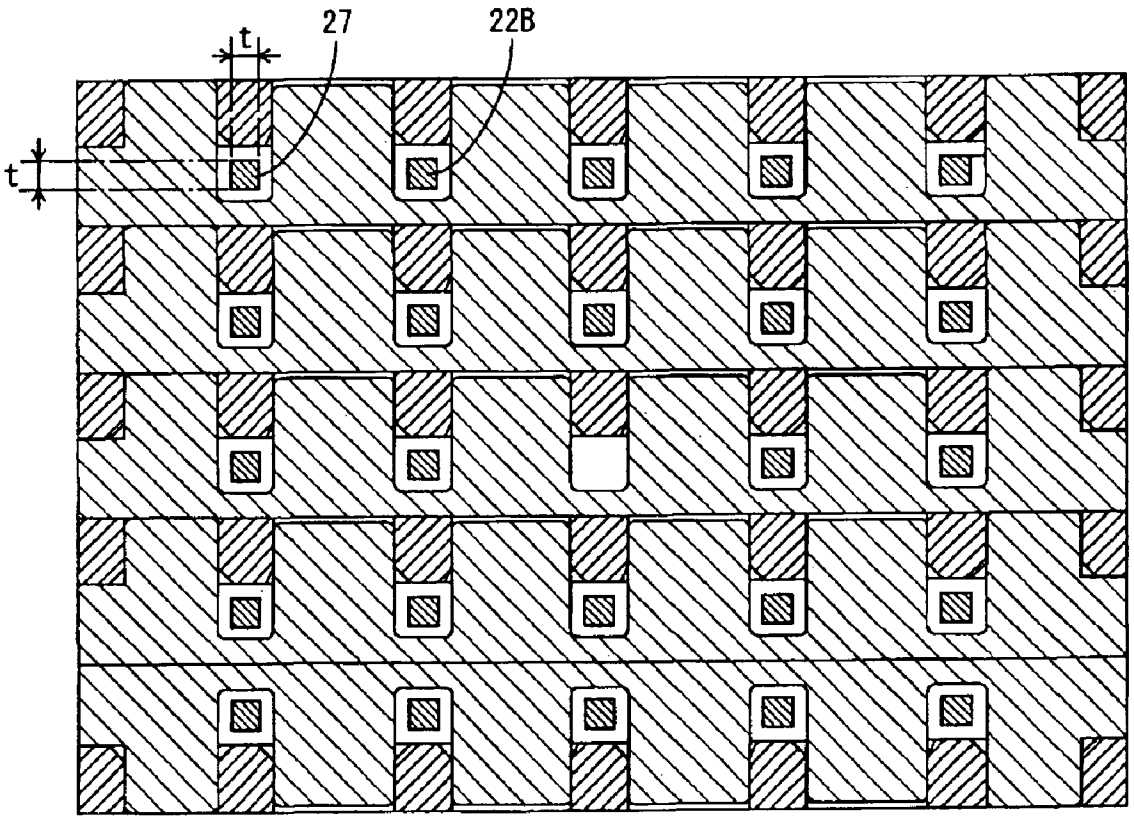
FIG. 10 is a section along 10—10 of FIG. 9 showing the respective groups of busbars having covers thereon and placed one over another.

As shown in FIG. 9, sections 27 of the branches 22B between the two holding portions 31, 32 are narrower than the other sections, and the width of these narrowed sections 27 is substantially equal to thickness t thereof. Thus, sections of the branches 22B surrounded by the covers 40 and in the displacement permitting spaces 51 have a substantially square cross section as shown in FIG. 10. Five branches are at each stage and five primary products are placed one over another. Thus, the same number of branches 22B arranged along the vertical direction equals the number of branches 22B along horizontal direction. Four branches 22B are at the middle stage. Thus, the first and third embodiments each have twenty four branches 22B. The branches 22B are partially narrowed and the external contacts 24 have the same horizontally long cross section as in the first embodiment. Thus, the construction of a mating power-supply connector needs not be changed.

In the above construction, the narrowed sections 27 of the branches 22B have substantially equal heights and widths. Thus, the narrowed sections 27 can displace similarly in the horizontal and vertical directions to accommodate relative displacements of the coupled and separated portions 61 and 62 of the outer covering element 60. Accordingly, displacements can be taken up more satisfactorily because the branches 22B can be displaced in vertical and/or horizontal directions substantially with the same ease. Further, displacements can be taken up even more satisfactorily because equal numbers of branches 22B are arranged along vertical and horizontal directions.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

Elastic members, such as rubber members, may be arranged in the displacement permitting spaces to form displacement permitting areas for permitting of resilient displacements of the branches.

The terminal holding portions are molded around the busbars in the foregoing embodiments. However, separately formed terminal holding portions may be assembled with the busbars according to the invention.

The terminal holding portions may be omitted. In such a case, the branches and the covers may be held to define the displacement permitting spaces by the mold for molding the outer covering element.

Several branches are coupled to each base in the foregoing embodiments. However, they may not be coupled to the base portion according to the present invention.

The terminal holding portions and the covers both are comprised of two pieces in the foregoing embodiments. However, they may be both comprised of one piece. Specifically, the second holding portions may be omitted and lattice-shaped covers may be fitted from the side of the external contact portions (see FIG. 2) to be mounted on the branches.

Although the groups of busbars are placed one over another at three or five stages in the foregoing embodiments, they may be placed one over another at two, four, six or more stages or may be arranged at one stage.

Connectors with substantially cranked shapes are illustrated in the foregoing embodiments. However, the invention is also applicable to L-shaped or straight-shaped connectors.

Although the intermediate connectors are illustrated in the foregoing embodiments, the invention is also applicable to connectors provided at ends of coil devices, bulb sockets and other electric devices.

What is claimed is:

1. A connector having an outer covering element (60) that comprises a coupled portion (61) and a separated portion (62), the coupled portion (61) being coupled to a cover (40) that is at least partly arranged around at least one terminal (22), the separated portion (62) being separated from both the cover (40) and the coupled portion (61), and a displacement permitting area (51) being defined between the terminal (22) and the cover (40) for permitting a displacement of the terminal (22).

2. The connector of claim 1, wherein a terminal holding portion (30) is fixed to the terminal (22), and the cover (40) is held onto the terminal holding portion (30).

3. The connector of claim 2, wherein the outer covering element (60) is formed by molding with a plurality of assemblies at least partly placed one over another, each assembly having a plurality of terminals (22) arranged substantially side by side and held by one said terminal holding portion (30) and the respective cover (40) is held onto the corresponding terminal holding portion (30).

4. The connector of claim 2, wherein each terminal holding portion (30) is fixed to the terminals (22) at substantially opposite sides of the corresponding cover (40).

5. The connector of claim 2, wherein each cover (40) comprises two divided pieces (41, 42) mountable on the terminals (22) in directions intersecting with a longitudinal direction of the terminals (22).

6. The connector of claim 1, wherein plural terminals (22) arranged substantially side by side, and each cover (40) includes at least one partition (48) for partitioning the respective terminals (22).

7. The connector of claim 1, wherein each terminal (22) has a horizontally long cross section, and a section of the terminal (22) in the displacement permitting area (51) is bent along a vertical direction at an intermediate position so that dimensions (T; t) of said section along horizontal and vertical directions are substantially equal.

8. The connector of claim 1, wherein each terminal (22) has a horizontally long cross section, and a section of the terminal (22) in the displacement permitting area (51) is narrower so that dimensions of said section along horizontal and vertical directions are substantially equal.

9. The connector of claim 1, wherein a number of the terminals (22) arranged along a horizontal direction and a number of the terminals (22) arranged along a vertical direction are equal.

10. A method of forming a connector, comprising the following steps:

forming an outer covering element (60) of the connector (10) by molding with a cover (40) at least partly arranged around at least one terminal (22), wherein the outer covering element (60) is formed to have a coupled portion (61) coupled to the cover (40) and a separated portion (62) separated from the cover (40), the coupled portion (61) and separated portion (62) being separate from each other, and wherein a displacement permitting area (51) for permitting a displacement of the terminal (22) is defined between the terminal (22) and the cover (40).

* * * * *